US005576510A

United States Patent [19]

Rudenauer

[11] Patent Number: 5,576,510

[45] Date of Patent: Nov. 19, 1996

[54] PERCUSSION FUSE FOR AMMUNITION

[75] Inventor: Werner Rudenauer, Roth, Germany

[73] Assignee: Gebruder Junghans GmbH, Schramberg, Germany

[21] Appl. No.: 558,534

[22] Filed: Nov. 16, 1995

[30] Foreign Application Priority Data

Dec. 1, 1994 [DE] Germany ..... 9419261 U

[51] Int. Cl.[6] ..... F42C 15/26; F42C 9/16

[52] U.S. Cl. ..... 102/231; 102/232; 102/238; 102/254; 102/266; 102/269

[58] Field of Search ..... 102/222, 223, 102/225, 226, 228, 229, 231, 232, 237, 238, 244, 245, 248, 254, 253, 256, 265, 266, 269, 276, 277.1

[56] References Cited

U.S. PATENT DOCUMENTS

| | | | |
|---|---|---|---|
| 3,422,764 | 1/1969 | Kaiser | 102/269 |
| 3,848,531 | 11/1974 | Mellen | 102/245 |
| 3,985,079 | 10/1976 | Post et al. | 102/266 |
| 4,901,643 | 2/1990 | Rudenauer et al. | 102/256 |
| 4,998,476 | 3/1991 | Rudenauer et al. | 102/226 |
| 5,048,419 | 9/1991 | Skowasch | 102/226 |

*Primary Examiner*—Harold J. Tudor
*Attorney, Agent, or Firm*—Burns, Doane, Swecker & Mathis, L.L.P.

[57] ABSTRACT

An impact fuse for a projectile comprises a firing needle and a main detonator carried by a rotor. The rotor is rotatable about an axis, upon launching of the projectile, and is rotated by centrifugal force from a safety position to a firing position in which the firing needle is aligned with the main detonator. Upon target impact, the rotor is displaced axially to cause the firing needle to detonate the main detonator. Acceleration forces occurring upon launching cause a piercing pin to activate a delay detonator. After a pre-selected time delay, the activated delay detonator emits a gas which displaces the rotor axially and produces detonation of the main detonator, in the absence of target impact.

6 Claims, 1 Drawing Sheet

PERCUSSION FUSE FOR AMMUNITION

BACKGROUND OF THE INVENTION

The invention concerns a percussion or impact fuse for ammunition, the fuse having a rotor pivotable to bring a firing pin into an armed position with respect to a detonator.

In the case of a conventional percussion or impact fuse for unrifled ammunition or rifled ammunition, it is necessary to ensure that dud shots are avoided, in the event of percussion fuse failure, The object of the invention therefore is to provide in a percussion fuse an inexpensive self-destruct means which is easy to produce.

SUMMARY OF A PREFERRED EMBODIMENT OF THE INVENTION

In accordance with the invention a mounting body serves for the arrangement of the safety elements and the rotor and for the fixing of a cover plate. At the bottom side of the mounting body a pierceable delay detonator is arranged in a recess. The recess is disposed transversely to the main axis of the fuse, while a movable piercing pin for the delay detonator is held by a bendable element in an orientation parallel to the main axis of the fuse. A gas bore disposed between the receiving space for the rotor and the recess for the delay detonator ensures that, after expiry of the self-destruct time, the delay detonator which is activated upon launch of the projectile, displaces by virtue of its volume of gas, the rotor axially. When that happens, a fixed firing needle penetrates into a piercing detonator of the rotor, thereby initiating a self-destruction of the ammunition.

The steps involved in regard to production procedure are simple and inexpensive to carry out. Because of the short gas bore, there are practically no energy losses upon detonation of the delay detonator. Dud shots are prevented by the self-destruct action.

The invention is suitable both for new fuse configurations and also as a retro-fit for fuses already in use.

BRIEF DESCRIPTION OF THE DRAWING

An embodiment of the invention is described hereinafter and illustrated in the drawing in which.

DETAILED DESCRIPTION OF A PREFERRED EMBODIMENT OF THE INVENTION

Figure 1:
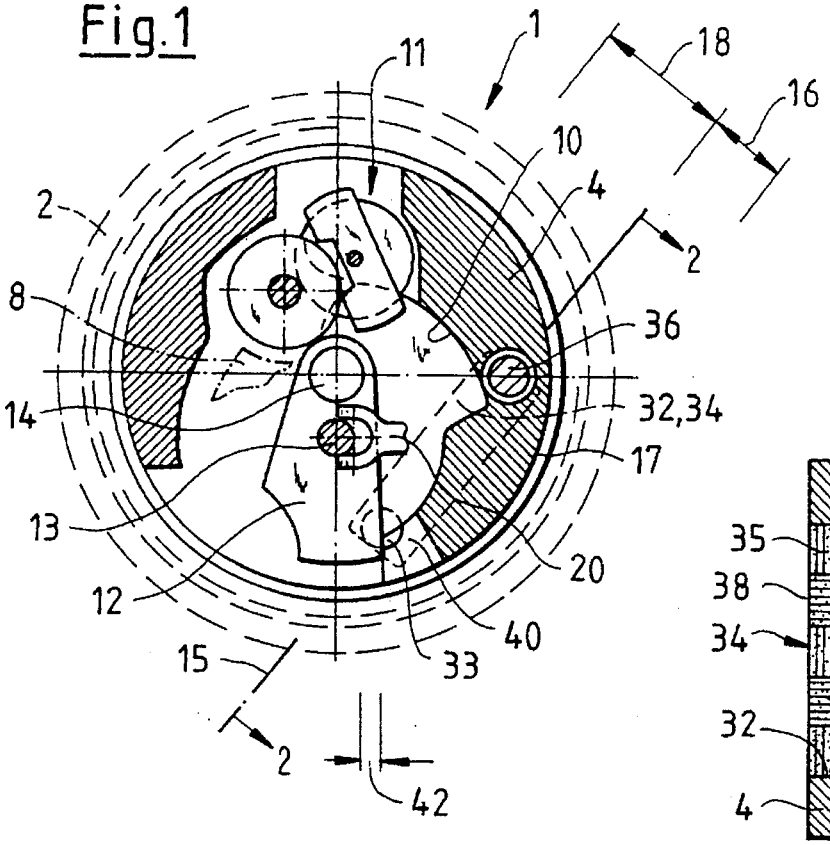
FIG. 1 is a view in cross-section of a rifled fuse in the live or armed position taken along line 1—1 in FIG. 3.

An impact or percussion fuse 1 for rifled ammunition has a fuse casing 2, a bottom plate 3, a mounting body 4 of circular cross-section with a cover plate 5 secured thereto, an 0-ring 6 and a cover 7.

Arranged in an intermediate space 10 is an escapement or retard mechanism 11, a rotor 12 with a rotary mounting 13 and pierceable main detonator 14, as well as a spring plate member 20. The above-described arrangement is fixed in the fuse casing 2 by the O-ring 6 and by the fuse casing 2 being bent inwardly at 21. The mechanism 11 is shown in schematic form.

Figure 2:
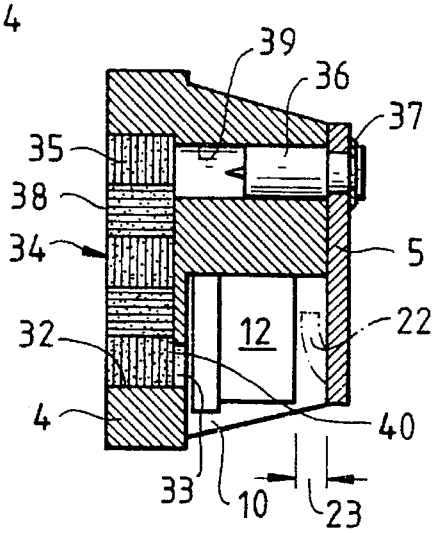
FIG. 2 is a view in section taken along line 2—2 in FIGS. 1 and 3.

Provided in the cover plate 5 are embossed knobs or projections 22 which are shown in dash-dotted lines in FIG. 2 and which hold the rotor, when in the safe position, at a spacing 23 from the cover plate 5.

Also provided in the cover plate 5 and in the mounting body 4 are mountings which are not further identified, for the mechanism 11 and for the rotary mounting 13.

Provided in the bottom side 30 of the mounting body 4, transversely to the main axis 31 of the impact or percussion fuse 1, is a recess 32 having a short gas directing passage in the form of a bore 33. The extended center line 15 of the recess 32 forms a secant of the cylindrical outer periphery 17 of the body 4, the secant 15 spaced radially inwardly from that periphery by a short spacing 16 (i.e., a spacing shorter than one half of a radius of the body 4). In order to provide the maximum length for the recess 32, the recess is disposed at the largest possible spacing 18 from the main axis 31. An encapsulated delay detonator 34 is arranged in the recess 32. An aluminum foil 38 moisture-tightly encloses the delay detonator 34. Adjacent a piercing region 35 of the delay detonator 34, a movable piercing pin 36 is mounted in a bore 39 in the mounting body 4, and is secured to the cover plate 5 by way of a bendable element 37 which can be deformed in response to acceleration forces as will be discussed. The bore 39 and the gas bore 33 extend from the head side of the fuse 1 and are disposed parallel to each other.

An outlet side 40 of the delay detonator 34 is disposed in the direct region of the gas bore 33 and the rotor 12 when in the live or armed position. The rotor 12 covers a region 42 of the gas bore 33.

Figure 3:
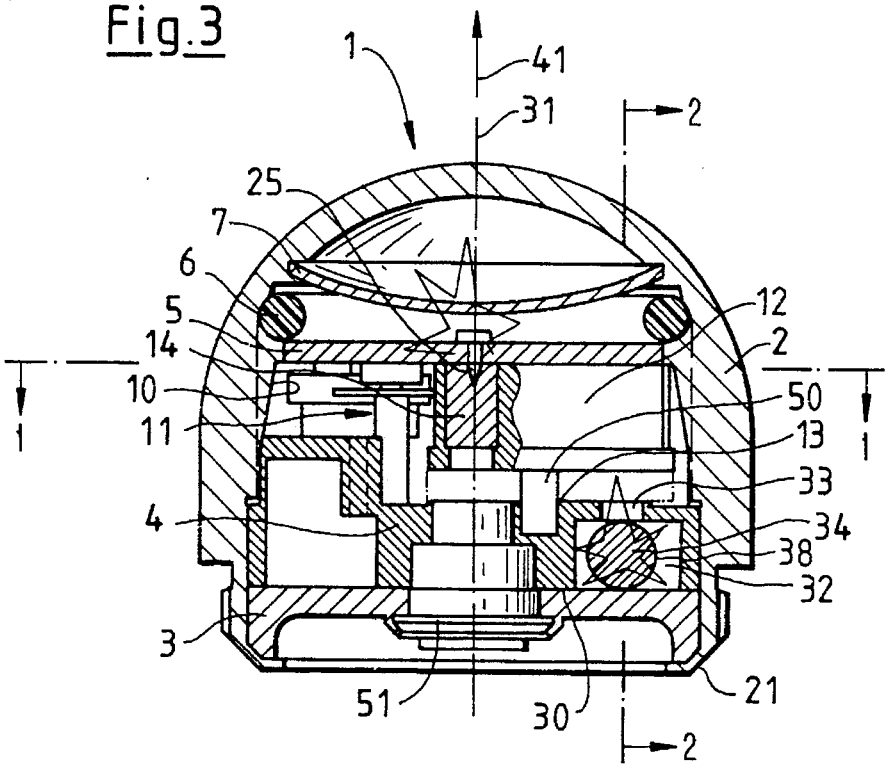
FIG. 3 is a view in longitudinal section of the fuse shown in FIG. 1 in the self-destruct function.

Regarding the mode of operation of the fuse:

After a piece of rifled ammunition (not shown) has been launched, the spin of the projectile produces centrifugal force which causes a pivotal movement of the rotor, by virtue of the center of gravity of the rotor being offset from the rotary mounting 13. The rotor rotates from its safe position 8 as shown in dash-dotted line in FIG. 1, into the so-called rear live position of the rotor 12 as shown in solid lines in FIG. 1. As long as the rotor 12 is in the safe position 8, the embossed knobs or projections 22 prevent an axial movement of the rotor 12 forwardly in the direction indicated by the arrow 41 (FIGS. 2 and 3). The pivotal movement of the rotor 12 into the live position occurs after a time delay due to the escapement mechanism 11, in which respect there is a tooth engagement between the rotor 12 and the mechanism 11 in a manner not shown in the drawing, but which is conventional.

The knobs or projections 22 are situated so that in the live position of the rotor 12, the knobs or projections 22 are out of engagement with the rotor and therefore no longer have any restraining effect. On the contrary the spring plate member 20 which is fixed to the mounting body 4 establishes the spacing 23 as shown in FIG. 2.

By virtue of the launch acceleration of the rifled ammunition, the bendable element 37 becomes deformed and releases the piercing pin 36 so that it pierces and activates the delay detonator 34, upon launch of the ammunition. Upon the occurrence of a target impact, the rotor 12 moves forwardly, whereupon the pierceable detonator 14 is pierced by the firing needle 25 carried by the cover plate 5 to detonate the detonator 14. That causes a boost charge 51 to fire in order to detonate the projectile.

If no target impact occurs after arming of the rotor 12, then an outlet gas thrust occurs after expiry of the delay time (of about 12 seconds) of the delay detonator 34. That gas thrust at the outlet side 40 is directed against the rotor 12 by the gas bore 33. The rotor 12, which is mounted on a pin 50 displaceably in the direction of the arrow 41, is accelerated in that direction 41 by the gas thrust, whereby the fixed firing needle 25 penetrates the main detonator 14 and fires it (see FIG. 3). The main detonator 14 then fires a boost charge 51 arranged in the mounting body 4 and the bottom plate 3. As a further consequence, the ammunition is then destroyed.

The described self-destruct arrangement only requires a change in the already existing mounting body 4 and, as additional components, the delay detonator 34 with piercing pin 36 and bending element 37. If the delay detonator 34 with piercing pin 36 is omitted, what remains is a fully adequate impact fuse 1, but without a self-destruct effect.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. An impact fuse for a rotatable projectile, comprising:

a main detonator;

a firing needle;

a rotor mounted for rotation about an axis from a safety position to a firing position under the influence of centrifugal force upon launching of the projectile, one of said main detonator and firing needle being carried by said rotor and arranged to become aligned with the other of said main detonator and firing needle in response to rotation of said rotor to said firing position, said rotor being movable along said axis in response to target impact when in said firing position to cause said firing pin to detonate said main detonator;

a delay detonator for emitting a gas flow after a predetermined time period following piercing of said delay detonator;

a piercing pin arranged to pierce and detonate said delay detonator in response to acceleration forces occurring upon launching of the projectile; and a gas-directing passage for directing the gas flow against said rotor to move said rotor along said axis to cause said firing pin to detonate said main detonator, in the absence of target impact.

2. The impact fuse according to claim 1, further including a mounting body having a recess extending orthogonally relative to said axis, said delay detonator disposed in said recess.

3. The impact fuse according to claim 2, further including a cover plate mounted on said mounting body, said piercing pin including a deformable portion mounting said piercing pin to said cover plate, said deformable portion being deformable in response to said acceleration force to said acceleration force for releasing said piercing pin from said cover plate.

4. The impact fuse according to claim 2, wherein a center line of said recess forms a secant with respect to a cylindrical outer periphery of said mounting body and is spaced from said periphery by a distance shorter than one half of a radius of said mounting body.

5. The impact fuse according to claim 2 wherein the piercing pin is mounted slidably in a bore of said mounting body and is oriented parallel to said gas directing passage.

6. The impact fuse according to claim 1 wherein said rotor is configured to at least partially overlie said gas-directing passage when in said firing position.

* * * * *